US006429783B1

(12) United States Patent
Reyes et al.

(10) Patent No.: US 6,429,783 B1
(45) Date of Patent: Aug. 6, 2002

(54) APPARATUS FOR INDICATING OPERATIONAL STATUS OF SEMICONDUCTOR FABRICATION EQUIPMENT

(75) Inventors: Jose Carlos Reyes, Austin; Michael McCarthy, Red Rock; Joanna Ramirez, Austin; Alfredo Garcia, Jr., Austin; Kelvinoge Morrissette, Austin; Donald K. Friede, Austin, all of TX (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/362,637

(22) Filed: Jul. 26, 1999

(51) Int. Cl.[7] ..... G08B 5/00

(52) U.S. Cl. ..... 340/815.4; 340/468; 340/473; 340/679

(58) Field of Search ..... 340/679, 680, 340/815.4, 468, 473, 425.5

(56) References Cited

U.S. PATENT DOCUMENTS 4,571,670 A * 2/1986 Kishi et al. ..... 364/171
4,831,504 A * 5/1989 Nishizawa et al. ..... 362/100
4,964,023 A * 10/1990 Nishizawa et al. ..... 362/100
5,955,972 A * 9/1999 Wade ..... 340/960
5,973,607 A * 10/1999 Munyon ..... 340/815.4
6,140,934 A * 10/2000 Lam ..... 340/815.4

* cited by examiner

*Primary Examiner*—Jeffery Hofsass
*Assistant Examiner*—Daniel Previl
(74) *Attorney, Agent, or Firm*—Kevin L. Daffer; Conley, Rose & Tayon P.C.

(57) ABSTRACT

An apparatus and method for indicating the operational status of equipment ("tools") used in semiconductor fabrication is provided. In one embodiment, the operational status of a tool is indicated by a mechanical sign attached to the tool. The sign contains indications of multiple operational statuses of the tool. The current operational status is indicated by covering the other possible operational statuses. The sign is constructed of materials that are compatible with the semiconductor fabrication environment. In a second embodiment, the operational status of a tool is indicated by illuminating a light. Lights for indicating possible operational statuses of the tool are attached to the tool. The lights may by illuminated by depressing a switch. Alternatively, the illumination of the lights may be controlled by a computer that also controls the operation of the tool. The computer may also cause an indication of the tool's operational status to be indicated on a monitor attached to the tool. An indication of a scheduled change in the tool's operational status may be indicated by flashing an appropriate light on and off at some predetermined time before the change occurs.

20 Claims, 5 Drawing Sheets

APPARATUS FOR INDICATING OPERATIONAL STATUS OF SEMICONDUCTOR FABRICATION EQUIPMENT

BACKGROUND OF THE INVENTION

1. Field of the Invention

This invention relates to manufacturing methods, and more particularly, to an apparatus and a method for indication of the operational status of equipment used in semiconductor fabrication.

2. Description of the Relevant Art

Fabrication of integrated circuits upon semiconductor substrates ("wafers") involves numerous pieces of equipment ("tools"), processing steps, and personnel. Wafer fabrication technicians (WFTs) are responsible, in part, for preparing wafers and processing wafers on various tools. Maintenance technicians' duties include maintaining and repairing tools. Tool manufacturer ("vendor") representatives may be present for evaluating and correcting problems with one or more tools. Engineers determine the required processing steps, a tool to be used for each processing step, and processing parameters to be used by the tool while performing that step. Managers may be responsible for overseeing a portion or all of the fabrication processing steps and coordinating the efforts of personnel associated with those steps. Efficient fabrication requires good communication between all personnel associated with the fabrication process.

A tool may have one of several operational statuses. For example, a tool may have an "up", "down", or "qualification" status. A tool with an up status is available to be used for processing wafers. A tool with a down status cannot be used for processing wafers. The tool may have the down status if a problem with the operation of the tool is discovered and corrective action is being taken. The tool may also be given the down status during regularly scheduled preventative maintenance. A tool with a qualification status cannot be used for processing product wafers, which are wafers upon which functional circuits are being fabricated. One or more test wafers, however, may be processed by the tool having the qualification status. Test wafers, which are wafers that do not have functional circuits being fabricated upon them, are typically processed using only a single tool for the purpose of assessing the performance of that tool. The tool may be given the qualification status during routinely scheduled checks of the tool's performance. The tool may also be given the qualification status after corrective action or after preventative maintenance has been performed on the tool having the down status.

Some of the tools used in semiconductor fabrication have multiple chambers within which wafers are processed. Each chamber of these tools may have its own individual operational status. For instance, one chamber may be broken and therefore have a down status while the remaining chambers are in good working order and have up statuses. For multiple-chambered tools, the operational status of the tool refers to the operational status of every chamber of the tool.

Semiconductor fabrication is typically performed in clean rooms. These are special areas in which the quantity of particles in the air is kept extremely low by continually flowing air from the ceiling to the floor and by ensuring the equipment and people in the clean room generate as few particles as possible. This is necessary since any particle that adheres to the surface of a wafer may destroy the integrated circuit being fabricated upon that portion of the wafer. Any device brought into the clean room must be essentially free of particles and further the operation of any device within the clean room must not generate large quantities of particles.

Each tool used in semiconductor fabrication is generally controlled by its own computer. Typically such a computer has one or more terminals next to the tool it controls. Each of these terminals usually consists of a monitor for sending output to a tool user and one or more input devices for the user. An automated factory system is often used to control the flow of wafers among tools and to ensure that the correct processing parameters are used for each wafer. This system is typically connected to the computers controlling the individual tools and this system may also maintain a database of the operational status of each tool. An example of an automated factory system is WorkStream™ sold by Consilium, Inc. of Mountain View, Calif.

It is important that all personnel associated with a tool are kept informed of the tool's operational status. Typically, two different forms of communication are used. The first form involves maintaining a record of the operational status of a tool in a computer database, typically the automated factory system. Personnel can find out the operational status of a given tool by logging onto the automated factory system and reading the operational status off the appropriate screen. The second form of communication is verbal. When a person changes the operational status of a tool, that person can then tell other personnel the tool's new operational status. Additionally, when personnel working with the tool are changed, such as during a shift change, the departing personnel can inform the arriving personnel of the current operational status of a tool.

Several problems can occur with these two forms of indicating the operational statuses of tools. Typically, a WFT is responsible for processing wafers on multiple tools in addition to other duties such as preparing wafers for processing. Preparing wafers for processing may include sorting wafers and performing pre- and post-processing measurement of the wafers. A tool with a down status may be repaired and given an up status by a maintenance technician while the WFT responsible for processing wafers on that tool is performing other duties at a different location. In this case, the maintenance technician will change the status of the tool in the automated factory system; however, since the WFT is not currently present, the maintenance technician cannot inform the WFT verbally of the change in operational status. If the WFT does not have occasion to check the operational status of the tool in the automated factory system, the WFT will not realize the tool is available for use. Hours may elapse before the WFT becomes aware that the tool can be used to process wafers. This idle time of the tool results in lost productivity and increased manufacturing costs.

During shift changes, the departing WFT has to inform the arriving WFT of the operational status of every tool for which he is responsible. Since a single WFT is often responsible for processing wafers on multiple tools, of which one or more of these tools may have multiple chambers, the WFT is required to remember the operational status of every tool in addition to other assignments the WFT may have. If the WFT forgets the operational status of a tool, he or she will have to stop what he is doing to check on the operational status in the automated factory system.

High-level managers may visit the fabrication area to check on the quality of the work being performed. Idle tools represent significant loss of productivity and increase of manufacturing costs. If a manager sees a tool not being currently used, he or she may find the WFT responsible for processing wafers on that tool and require the WFT to explain why the tool is idle. This takes time away from the WFT's duties and decreases his or her efficiency even though the tool may be currently idle for good reason. For example, the tool may have a qualification status, a test wafer may have recently been run on the tool, and the WFT is currently waiting on an assessment of that test wafer.

Tools may also be scheduled to be temporarily removed from production. For instance, a tool may be given a down status for regularly scheduled maintenance or a tool may be given a qualification status for a regularly scheduled check of the tool's performance. In these instances, the WFT that is processing wafers on a tool may be unaware that the tool will be taken out of production at a specific time. If the WFT had a reminder that the tool was to be taken out of production, the WFT could adjust the processing of wafers to ensure that the wafers of highest priority are processed before the tool is removed from production.

It is therefore desirable to develop a supplemental form of indicating the operational status of a tool that would allow any personnel working in the vicinity of a tool to easily determine its operational status. It is also desirable if some form of a warning about a scheduled change in the operational status of a tool could be given. It is further desirable that any additional indication of the tool's operational status be coordinated with the tool's status as recorded in the automated factory system to avoid any confusion about the actual status of the tool.

SUMMARY OF THE INVENTION

The problems outlined above are in large part addressed by an apparatus that continuously indicates the operational status of the tool to which it is attached. Such an apparatus allows any personnel in the vicinity of the tool to determine the operational status of the tool by looking at (or listening to) the apparatus. Since the apparatus is attached to the tool, any change of the tool's operational status can be quickly noticed. For instance, if a maintenance technician places a tool in the up status after making repairs and cannot find the WFT to inform him that the repairs are complete, the WFT will notice the change in operational status the next time the he is in the vicinity of the tool. Additionally, any other personnel, such as a manager, can walk past the tool and determine its operational status without having to interrupt the work of others to inquire about the tool's status.

In one embodiment, the apparatus is a mechanical sign that displays in color and/or words the operational status of the tool. The sign is preferably attached to the front of the tool and is constructed of materials that are compatible with the semiconductor fabrication environment. The sign may be formed such that it includes a separate section for indicating each operational status of the tool. For example, there may by three sections, one each for the up status, the down status, and the qualification status. Each section may contain the words, "up", "down", or "qualification", as appropriate. Additionally, the up section may be colored green, the qualification section may be colored yellow, and the down section may be colored red. To denote the current operational status, covers may be used to hide the other two status indication sections. If the tool contains multiple chambers, the sign preferably comprises sections for indicating each possible operational status for each chamber.

In a preferred embodiment, the mechanical sign comprises labels for each of the sections held between two pieces of clear, static-free Lexan™. The continual air flow present in the clean rooms where semiconductor fabrication occurs tends to cause insulating surfaces to acquire an electrical charge. The use of static-free Lexan™ in the construction of the sign prevents this charging from occurring. Lexan™ is manufactured by the General Electric Company of Schenectady, N.Y. The covers are preferably made from opaque, static-free Lexan™ and are attached to the sign by Teflon™ roller bearings held captive in grooves located on the sign. The covers can be moved by hand to allow the appropriate operational statuses to be covered. The use of Teflon™ bearings reduce the quantity of particles that may be generated when the covers are moved. Teflon™ is made by the E. I. du Pont de Nemours and Company of Wilmington, Del. Additionally, the grooves may also contain notches to retain the cover directly in front of one of the operational status indications. An advantage of a mechanical sign is that it requires no electrical connections and contains very few parts that could break or malfunction. The mechanical sign should therefore last the lifetime of the tool to which it is attached and will most likely never fail and require repair.

To ensure that the operational status indicated by the sign agrees with the operational status recorded by the automated system, a video camera may be used to check the operational status indicated by the sign. The video camera may be taught the location of the sign and can determine the operational status indicated by the sign by determining which color is displayed by the sign. This indication can then be compared to the operational status recorded by the automated system. If disagreement is found, a warning can be generated to inform the appropriate personnel of the discrepancy.

In another embodiment, the apparatus is a set of lights or audible signals corresponding to the possible operational statuses of the tool. The current operational status is indicated by illuminating the appropriate light or activating the appropriate signal. For example, the lights may indicate the operational statuses by color and/or words. For example, there may be three lights, one each for the up, down, and qualification statuses. The words, "up", "down", and "qualification" may be written on or near the lights. Additionally, the light may be colored green to indicate the up status, red to indicate the down status, and yellow to indicate the qualification status. If the tool contains multiple chambers, the apparatus preferably comprises a set of lights for the possible operational statuses for each chamber.

In one embodiment, personnel such as WFTs or maintenance technicians may manually illuminate the appropriate light by activating a switch placed near the light. In a preferred embodiment, the lights are an integral part of the tool and the illumination of the lights is controlled by the computer that controls the tool. The computer would read the operational status of the tool from the automated work system. The computer could then send signals that would cause the appropriate light to be illuminated. This would guarantee that the operational status recorded by the automated factory system would agree with the operational status displayed by the lights.

A method for indicating the operational status of a tool is also contemplated herein. The method includes changing the status of the tool recorded by the automated factory system. A computer that controls the tool is linked to the automated factory system. The automated factory system then downloads the new operational status to the computer. The computer then causes the new operational status of the tool to be indicated. The operational status may be indicated by a set of lights as discussed above or the operational status may be displayed upon a monitor that comprises an output terminal of the computer. The operational status is preferably displayed as words upon the monitor.

The method further contemplates indicating any scheduled changes of the operational status of the tool. For instance, if the tool is scheduled to be placed in the down status for preventative maintenance, this may be indicated at some time prior to the tool actually being placed in the down status. Scheduled changes in the operational status are recorded in the automated factory system. At some time prior to the scheduled change, for example two hours beforehand, the automated factory system can download this information to the computer that controls the tool. The computer can then indicate that the scheduled change is to occur by flashing the appropriate light or by flashing the appropriate operational status on the monitor. By warning personnel of the impending change in operational status, they can ensure that they are ready for the change in status when it occurs. For instance, if the tool is being placed in the down status for preventative maintenance, the appropriate personnel can ready themselves so that they can begin work as soon as the tool is given the down status. This will minimize the time the tool is in the down status and that in turn increases manufacturing efficiency and reduces manufacturing costs.

BRIEF DESCRIPTION OF THE DRAWINGS

Other objects and advantages of the invention will become apparent upon reading the following detailed description and upon reference to the accompanying drawings in which.

Figure 1:
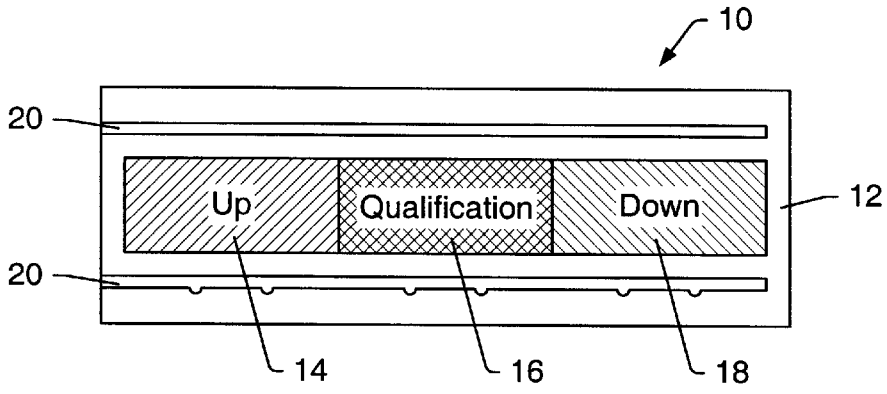
FIG. 1 is a schematic of a mechanical sign for indicating the operational status of a tool.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed. On the contrary, the intention is to cover all modifications, equivalents, and alternatives falling within the spirit and scope of the present invention.

DETAILED DESCRIPTION OF THE PREFERRED EMBODIMENTS

Turning to the drawings, FIG. 1 is a schematic of a mechanical sign for indicating the operational status of a tool. Sign 10 indicates the operational status for a tool which has three different possible operational statuses. Label 14 indicates an up status of the tool. This section may contain the word "up" and/or may be colored green. Label 16 indicates a qualification status of the tool. This section may contain the word "qualification" and/or may by colored yellow. Label 18 indicates a down status of the tool. This section may contain the word "down" and/or may be colored red. Labels 14, 16, and 18 are held between two pieces of clear material 12. Material 12 is preferably composed of static-free Lexan™. Grooves 20 are located in the front surface of sign 10 to hold covers (not shown) that prevent viewing of two of the three labels.

Figure 2:
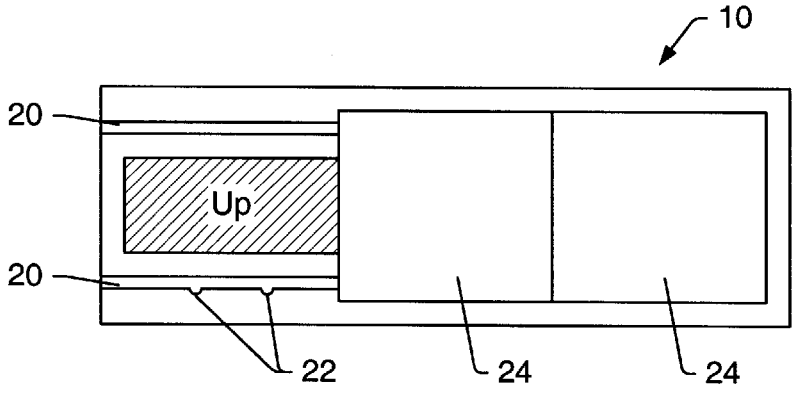
FIG. 2 shows the sign of FIG. 1 in which covers have been placed over portions of the sign to indicate the tool's current operational status.

FIG. 2 shows sign 10 of FIG. 1 with covers 24 in place. The placement of covers 24 in front of labels 16 and 18 indicates that the tool has an up status. Covers 24 are preferably made of opaque, static-free Lexan™ and are attached to sign 10 by roller bearings captured in grooves 20. Personnel can move the covers to indicate different operational statuses of the tool. Notches 22 are provided in grooves 20 for the purpose of retaining cover 24 directly in front of one of labels 14, 16, or 18.

Figure 3:
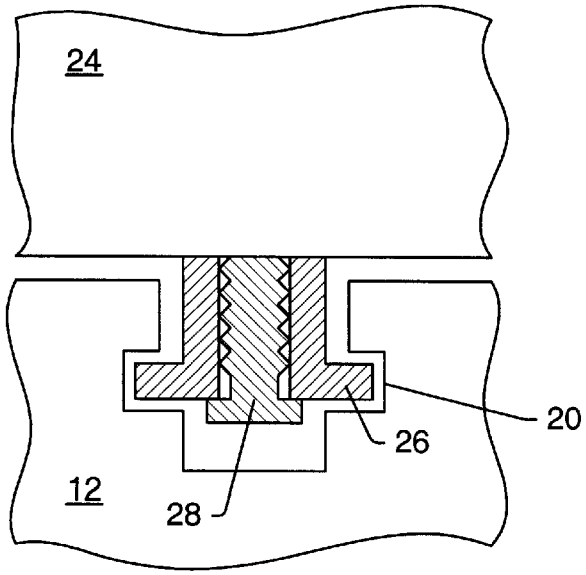
FIG. 3 is a cross-sectional view of the attachment of the covers to the sign of FIG. 2 using roller bearings.

FIG. 3 shows a cross-sectional side view of how roller bearing 26 may be captured within groove 20. Bearing 26 is attached to cover 24 with screw 28. As cover 24 is moved, bearing 26 is free to roll in groove 20. Bearing 26 is preferably composed of Teflon™ to reduce the number of particles generated when cover 24 is moved. Cover 24 is preferably attached to sign 10 using 4 to 6 bearings.

Figure 4:
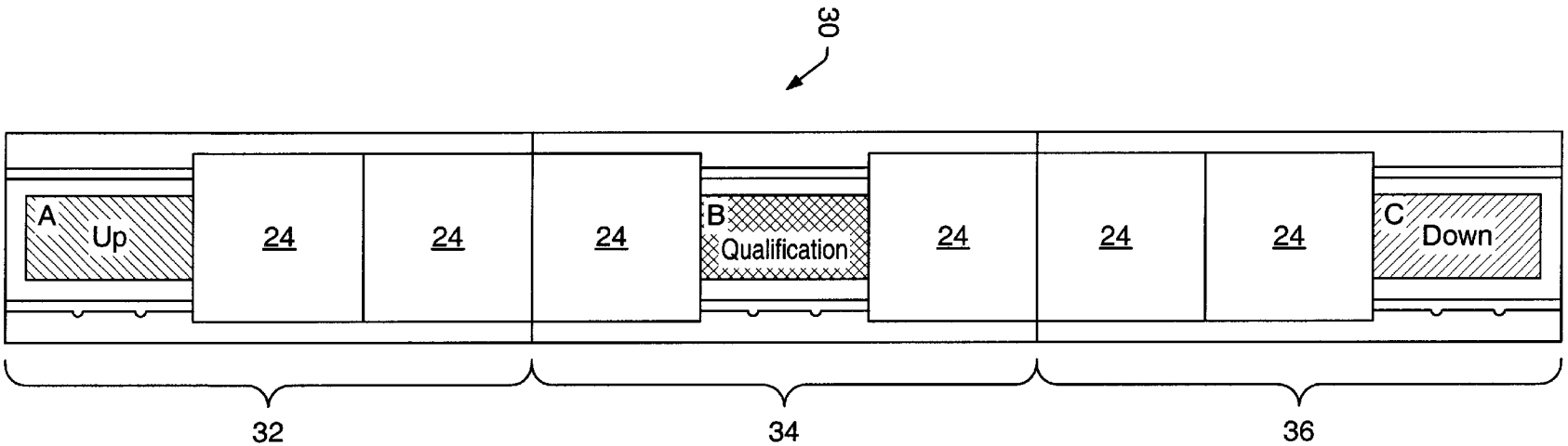
FIG. 4 illustrates a mechanical sign that indicates the operational status of a tool that contains multiple chambers each of which has its own operational status.

FIG. 4 depicts sign 30 for a tool that contains three chambers, each of which may have a separate operational status. The sign contains sections 32, 34, and 36 that indicate the operational status of chambers A, B, and C, respectively. As can be seen by the placement of covers 24, chamber A has an up status, chamber B has a qualification status, and chamber C has a down status in the embodiment of FIG. 4. Additional sections could be added to or removed from sign 30 if the tool had more than or less than three chambers.

Figure 5:
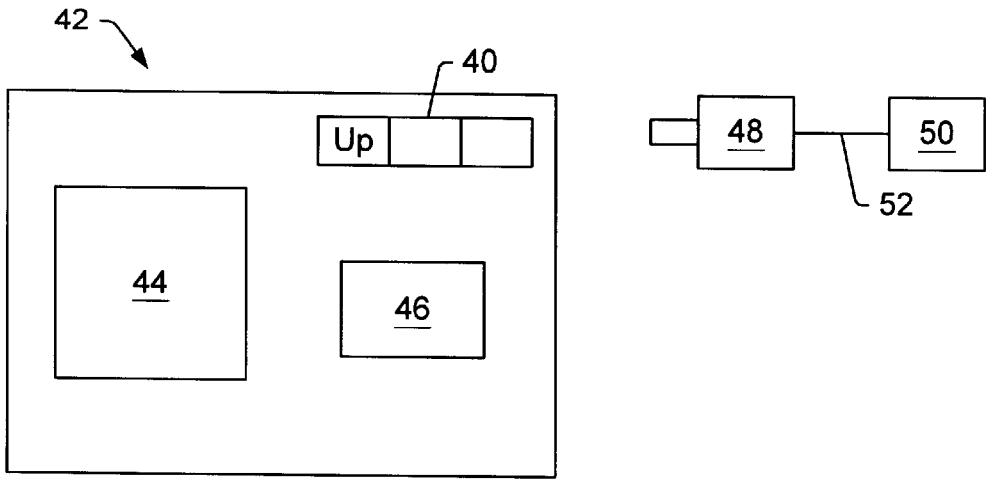
FIG. 5 depicts a technique for determining the operational status indicated by a mechanical sign.

FIG. 5 illustrates a technique for ensuring that the operational status recorded by the automated factory system is the same as displayed by sign 40 attached to front end 42 of a tool. In this example, front end 42 is shown to have loadlock 44 for placing wafers within the tool and monitor 46 for displaying information to personnel using the tool. Front end 42 may also have other items such as input devices for personnel to enter information. In this example, sign 40 indicates that the tool has an up status. Video camera 48 is positioned such that it can observe sign 40. Video camera 48 may take an image of sign 40 and download that image to computer 50 through wire 52. Computer 50 can interpret the color displayed by the sign and thereby determine the operational status indicated by sign 40. Computer 50 can then compare the operational status displayed by sign 40 to the operational status recorded by the automated factory system and alert the appropriate personnel if the two statuses do not agree.

Figure 6:
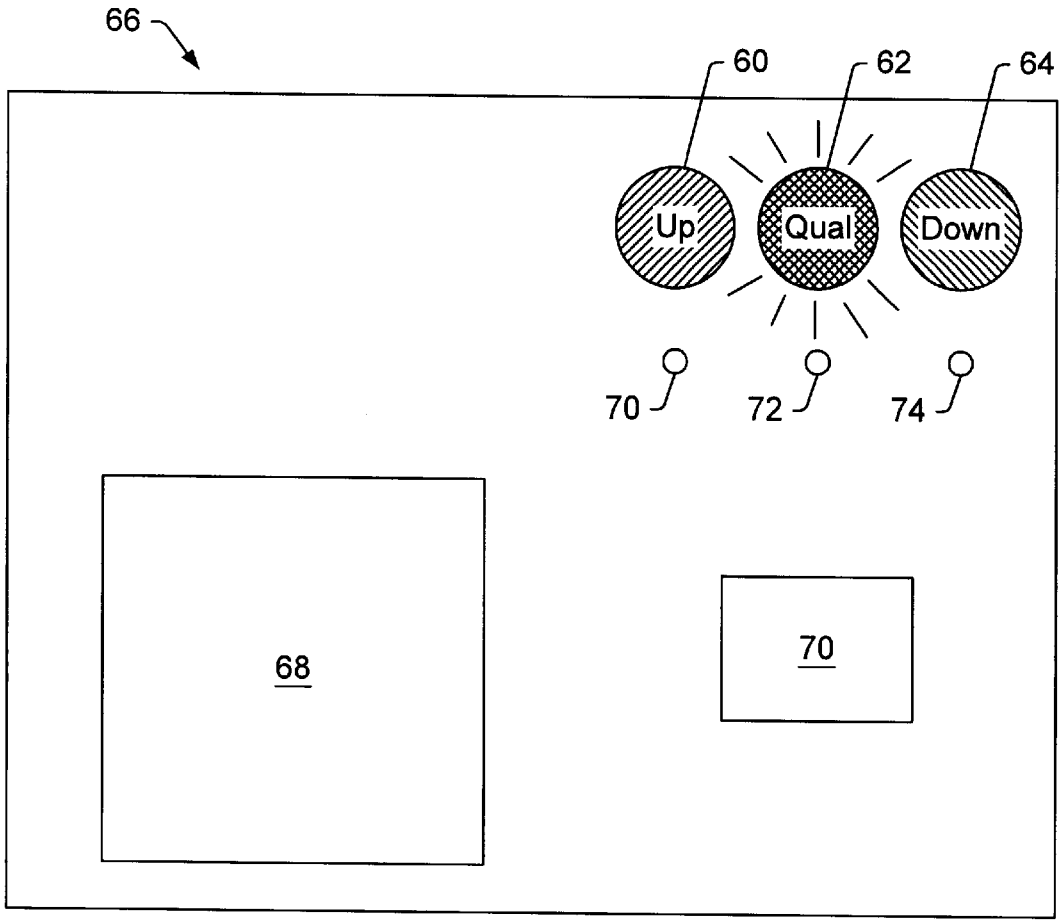
FIG. 6 shows a set of lights attached to a tool for indicating the operational status of the tool.

FIG. 6 shows an alternative method for indicating the operational status of a tool. One of lights 60, 62, and 64 may be illuminated to indicate the operational status of the tool. Lights 60, 62, and 64 are attached to front end 66 of the tool. Front end 66 is shown to have loadlock 68 and monitor 70 but may also include other structures. Light 60 is used to indicate the tool has an up status and may have the word "up" written on or near light 60 and may be colored green. Light 62 is used to indicate the tool has a qualification status and may have the word "qualification" (abbreviated as "qual" in FIG. 6) written on or near light 62 and may be colored yellow. Light 64 is used to indicate the tool has a down status and may the words "down" written on or near light 64 and may be colored red. In FIG. 6, light 62 is illuminated indicating that the tool currently has a qualification status. If the tool has more than one chamber, additional lights can be added to front end 66 to indicate the operational status for each chamber.

Switches 70, 72, and 74 may be used to illuminate lights 60, 62, and 64, respectively. Activation of one of the switches causes the currently illuminated light to be turned off and causes the light associated with the switch to be illuminated. Alternatively, switches 70, 72, and 74 can be eliminated and the illumination of lights 60, 62, and 64 can be accomplished using the computer which controls the tool. This computer may be connected to the automated factory system. The computer may download the operational status of the tool from the automated factory system and then send out a signal that causes the appropriate light to be illuminated.

Figure 7:
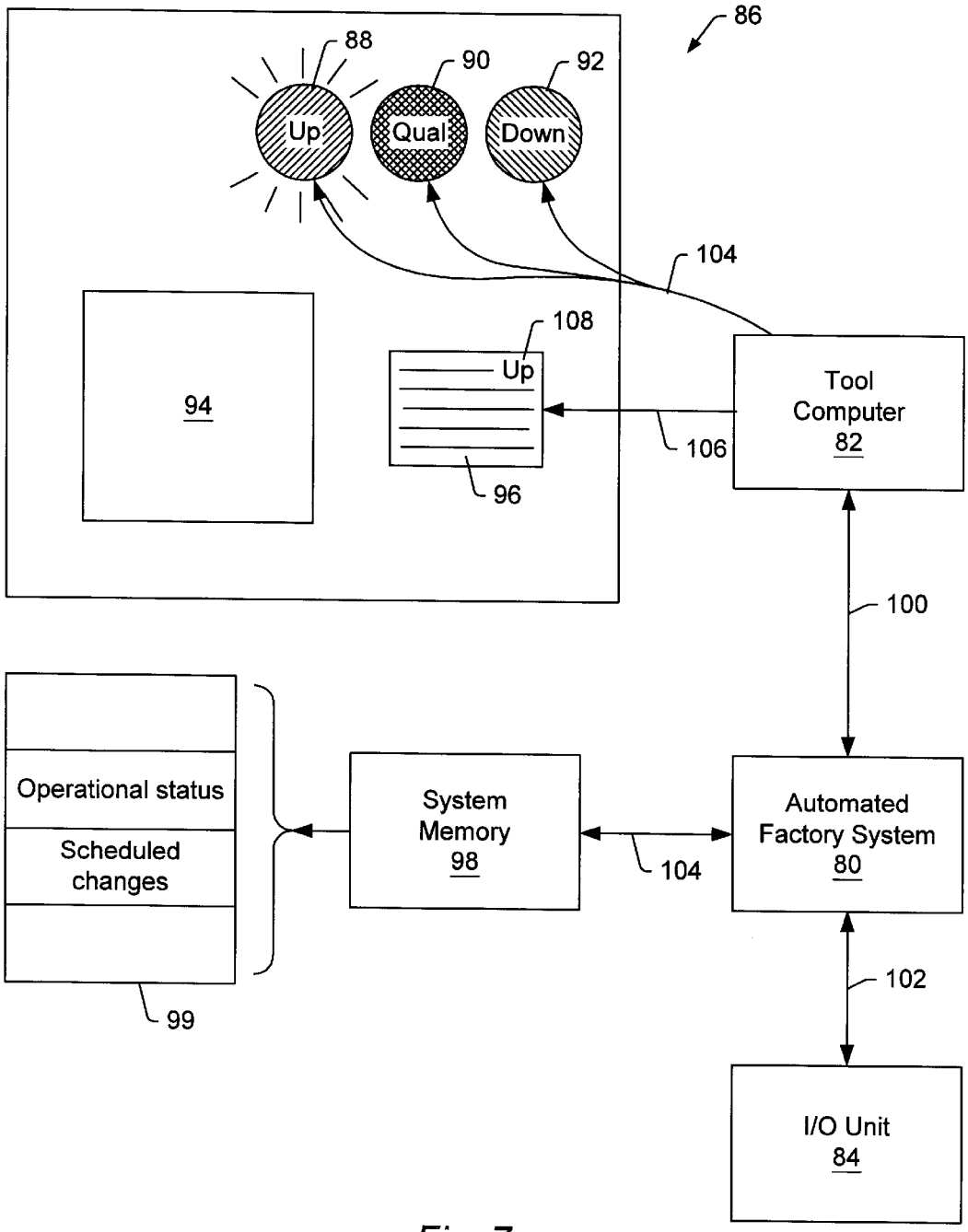
FIG. 7 is a block diagram for the interconnection of a computer system and an apparatus for indicating the operational status of a tool.

FIG. 7 illustrates a block diagram for interconnecting a computer system and an apparatus for indicating the operational status of a tool. Automated factory system 80 controls the semiconductor fabrication process. I/O unit 84 is connected to automated factory system 80 by bus 102 and allows personnel to input the operational status of a tool. Automated factory system 80 is connected to system memory 98 by two-way bus 104. System memory 98 is either a volatile or non-volatile storage medium. A portion of the information, which includes the operational status of the tool, stored in system memory 98 is shown in memory address space 99. Tool computer 82 is connected to automated factory system 80 by bus 100. Tool computer 82 controls the operation of the tool. Automated factory system 80 can download the tool's operational status to tool computer 82 that can in turn cause the operational status to be indicated on front end 86 of the tool.

Front end 86 may contain lights 88, 90, and 92 for indicating the operational status of the tool, loadlock 94 for loading wafers into the tool, and monitor 96 for displaying information. Computer 82 is connected to lights 88, 90, and 92 by bus 104 and to monitor 96 by bus 106. Computer 82 can use the operational status downloaded from automated factory system 80 to cause the appropriate light to be illuminated. In FIG. 7, the tool is indicated to have an up status since light 88 is illuminated. Additionally or alternatively, computer system 82 can indicate the tool's operational status by displaying it on monitor 96. In the embodiment of FIG. 7, the tool's up status is indicated by the word "up" in the upper right-hand corner 108 of monitor 96.

Memory address space 99 of automated factory system 80 may also contain records of scheduled changes in the operational status of the tool. At some predetermined time before the scheduled change, automated factory system 80 can download a notice of the scheduled change to tool computer 82. Computer 82 can then indicate the forthcoming change in operational status by flashing the appropriate light on and off. For instance, if the operational status will be changed to the qualification status, computer 82 would cause light 90 to flash. Additionally or alternatively, computer 82 could cause the word "qualification" to be flashed on and off on monitor 96.

Figure 8:
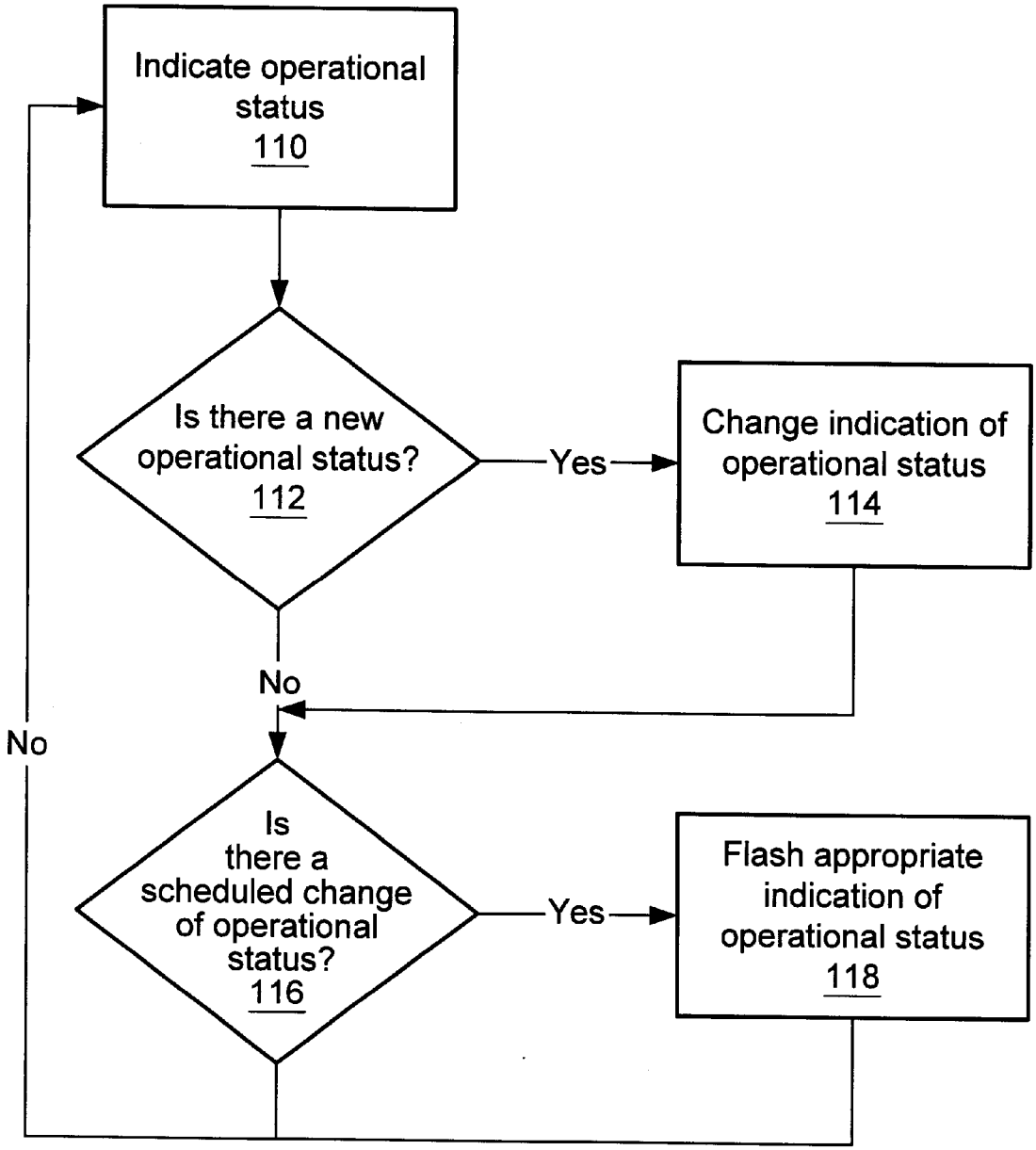
FIG. 8 is a flow diagram for implementing a method for indicating the operational status of a tool.

FIG. 8 is a flow diagram for implementing a method for indicating the operational status of a tool. Initially, a computer connected to the tool causes the tool's operational status to be indicated (box 110). This indication may be either the illumination of a light attached to the tool or words displayed on a monitor. The computer then determines whether a new operational status has been downloaded by the automated factory system (box 112). If the operational status has changed, the computer causes the indication of the tool's operational status to be changed (box 114). This may be accomplished by either changing which light is illuminated or changing the word displayed on the monitor. The computer then checks if a notice of a scheduled change of operational status has been downloaded by the automated factory system (box 116). If a scheduled change has been downloaded, the computer then causes an indication of the forthcoming change to be displayed (box 118). This may be accomplished by flashing the appropriate light on and off or by causing the appropriate word to flash on and off on the monitor. The cycle then repeats itself when the computer checks if a new operational status has been downloaded by the automated factory system (box 112).

It will be appreciated to those skilled in the art having the benefit of this disclosure that this invention is believed to provide an apparatus and method for indicating the operational status of a tool used in semiconductor fabrication. Further modifications and alternative embodiments of various aspects of the invention will be apparent to those skilled in the art in view of this description. For example, a tool may have more or less than three operational statuses indicated by the sign or lights and these operational statuses may be different from those discussed above. It is intended that the following claims are interpreted to embrace all such modifications and changes and, accordingly, the specification and drawings are to be regarded in an illustrative rather than a restrictive sense.

What is claimed is:

1. An apparatus for displaying an operational status of a tool used in semiconductor fabrication, the apparatus comprising:

a sign attached to the tool, wherein the sign includes indications of multiple operational statuses of the tool; and one or more covers, wherein a placement of the covers is such that only the current operational status of the tool is revealed.

2. The apparatus of claim 1, wherein the sign comprises multiple sections, wherein each section indicates one of the operational statuses of the tool.

3. The apparatus of claim 2, wherein the sign comprises labels for each of the sections held between two pieces of clean-room-compatible material.

4. The apparatus of claim 3, wherein the clean-room compatible material comprises clear, static-free Lexan™ comprises a plastic material sold under the trademark Lexan.

5. The apparatus of claim 3, wherein a color of and/or words written on each of the labels denotes the corresponding operational status.

6. The apparatus of claim 4, further comprising a video camera, wherein the video camera is adapted to obtain an image of the sign, and wherein the current operational status of the tool is obtainable from the image based upon the color revealed by the covers.

7. The apparatus of claim 1, wherein the operational statuses of the tool are an up status, a down status, and a qualification status.

8. The apparatus of claim 1, wherein the sign further includes multiple operational statuses for each chamber of the tool.

9. The apparatus of claim 1, wherein the covers comprise a clean-room-compatible material.

10. The apparatus of claim 9, wherein the clean-room-compatible material comprises opaque, static-free Lexan™ comprises a plastic material sold under the trademark Lexan.

11. The apparatus of claim 1, wherein the covers are attached to the sign using roller bearings captured in grooves located on the front of the sign, wherein the bearings allow the covers to be moved across a front surface of the sign, and wherein the bearings comprise a low-particle-generating material.

12. The apparatus of claim 11, wherein the low-particle-generating material comprises Teflon™ comprises a polymer material sold under the trademark Teflon.

13. The apparatus of claim 11, wherein the grooves comprise notches to retain the cover directly in front of one indication of the operational status.

14. An apparatus for indicating an operational status of a tool used in semiconductor fabrication, the apparatus comprising three separate lights attached to the tool, wherein each of the lights indicates one of the three operational statuses of the tool, and wherein an illumination of one of the lights indicates the current operational status as being either an up status, a down status, or a qualification status of the tool.

15. The apparatus of claim 14, wherein the lights are color coded to indicate the operational status of the tool.

16. The apparatus of claim 14, wherein words written on or near the lights indicate the operational status of the tool.

17. The apparatus of claim 14, further comprising lights corresponding to the three operational statuses for each chamber of the tool.

18. The apparatus of claim 14, wherein user-actuated switches placed near the lights control the illumination of the lights.

19. The apparatus of claim 14, wherein the lights are integrated into an infrastructure of the tool.

20. The apparatus of claim 19, wherein the lights are connected to a computer that controls the tool, and wherein the computer controls which of the lights are illuminated.

* * * * *

UNITED STATES PATENT AND TRADEMARK OFFICE

CERTIFICATE OF CORRECTION

PATENT NO. : 6,429,783 B1
DATED : August 6, 2002
INVENTOR(S) : Reyes et al.

It is certified that error appears in the above-identified patent and that said Letters Patent is hereby corrected as shown below:

Title page,
Item [75], Inventors, delete the inventor named "Donald K. Friede" and substitute therefor -- Donald L. Friede --.

Signed and Sealed this

First Day of April, 2003

JAMES E. ROGAN
*Director of the United States Patent and Trademark Office*